United States Patent [19]

Matsuno

[11] Patent Number: 4,756,693

[45] Date of Patent: Jul. 12, 1988

[54] APPARATUS TO SPREAD A SAMPLE OF SEAT TOP MATERIAL

[75] Inventor: Shigeru Matsuno, Otsu, Japan

[73] Assignee: Kawashima-Orimono Co., Ltd., Japan

[21] Appl. No.: 948,018

[22] Filed: Dec. 31, 1986

[30] Foreign Application Priority Data

Jan. 20, 1986 [JP] Japan ..... 61-10899

[51] Int. Cl.[4] ..... G09F 5/00

[52] U.S. Cl. ..... 434/365; 434/72

[58] Field of Search ..... 434/365, 367, 373, 433, 434/72, 75

[56] References Cited

U.S. PATENT DOCUMENTS 1,811,766 6/1931 Steadman et al. ..... 434/75

2,790,252 4/1957 Volland ..... 434/373

3,430,364 3/1969 Kirschbaum et al. ..... 434/75

*Primary Examiner*—William H. Grieb

*Attorney, Agent, or Firm*—Darby & Darby

[57] ABSTRACT

A display device for upholstery material and the like including a central section and an arched surface of an upwardly inclined inner surface and downwardly inclined outer surface joined by a curved section on each side of the central section. A channel is formed at the intersection of the arched surface and the central section and channels are formed across the length and width of the central section. The material is draped over the central section and the arched surface and depressed into one or more of the channels to hold the material and to correspond to the various parts of an article on which the material is to be used.

8 Claims, 2 Drawing Sheets

APPARATUS TO SPREAD A SAMPLE OF SEAT TOP MATERIAL

BACKGROUND OF THE INVENTION

This invention relates to an apparatus which is used to estimate the aesthetic appearance and the sense of touch of seat top material such as, pile fabrics, embossed fabrics, woven or knitted fabrics, artificial leather, synthetic leather and the like, by spreading and attaching a sample of these material to the chair body to be upholstered.

A seat top material is estimated and selected by the purchaser by imagining the appearance of chair upholstered with it and considering whether it is suitable for the upholstery. However, in the case of such seat top material as pile fabric, embossed fabric and artificial leather, where the nap or fluff tends to incline toward the same direction and an irregular reflection occurs on the surface, their appearances changes in color tone either light or dark. On the other hand, the surface of the seat portion and backrest of the chair is not always flat, but generally curved as in the passenger car seat and the edge of the seat which is higher than the center portion. For these reasons, it is necessary to observe the appearance of the many samples of seat top material from various viewpoints and to consider from all sides and conditions the variation in color tone imagining the actually used state.

As mentioned above, according to the prior art, a fertile imagination is required to estimate and select the best seat top material. But, it is impossible to expect such an ability from every purchaser. Especially, it is very difficult to select from different colors the material used for a two tone color chair of which the center and the border of the seat portion and the backrest are of different colors.

Thus, a trial seat has to be produced by sewing each sample of seat top material onto the seat portion and the backrest. However, this is not only very troublesome but also uneconomical, because the trial seats with the sample of seat top material have to be discarded when not actually used. Moreover, it is troublesome to transport and display the trial chairs upholstered in a sample of seat top material.

SUMMARY OF THE INVENTION

To solve the problem in the prior art, the present invention provides an apparatus to spread a sample of seat top material. This apparatus comprises a flat plane. An arch formed by an upwardly inclined inner surface extends from each side of the flat plane and a downwardly inclined outer surface continuing from the top portion of the upwardly inclined inner surface. A channel formed by an upwardly inclined inner plane and a downwardly inclined outer plane is on each side of the flat plane. Along the edges of the flat plane from which the arches extend, there are side channels of width from 3 to 10 mm and depth more than twice width.

The sample of seat top material is detachably attached by embedding it with a spatula or like object into these channels, so that samples can very easily be changed when applied on the apparatus one after another. On the other hand, the flat plane is similar to the concave middle portions of a chair and the upwardly inclined inner surface and the downwardly inclined outer surfaces forming the arches are similar to the curved border portions of a chair.

Therefore, when the whole surface of a sample of seat top material attached on the apparatus is observed, its appearance can be observed as if it was really applied onto the chair. As a result of this, fitting and cutting of the sample of seat top material to produce a trial chair can be eliminated, the loss of material is minimized if not eliminated and from many samples the best choice can be decided upon speedily.

Therefore, the objects of the invention are;

1. to provide an apparatus to display the sample of seat top material as it is actually used, covering the chair and giving it dimensions, making it possible to confirm its appearance.
2. to provide an arrangement to attach and detach easily the sample of seat top material on the chair so that the best choice can be made.
3. to reduce the cost of the sample of seat top material by selecting the best designs from many choices without cutting and sewing the sample and without producing a trial seat.
4. to make it easy and convenient to transport and display the samples of seat top material.

Further objects and advantages of the present invention will be apparent by following description of the preferred embodiment illustrated in the accompanying drawings.

DETAILED DESCRIPTION OF THE INVENTION

Figure 1:
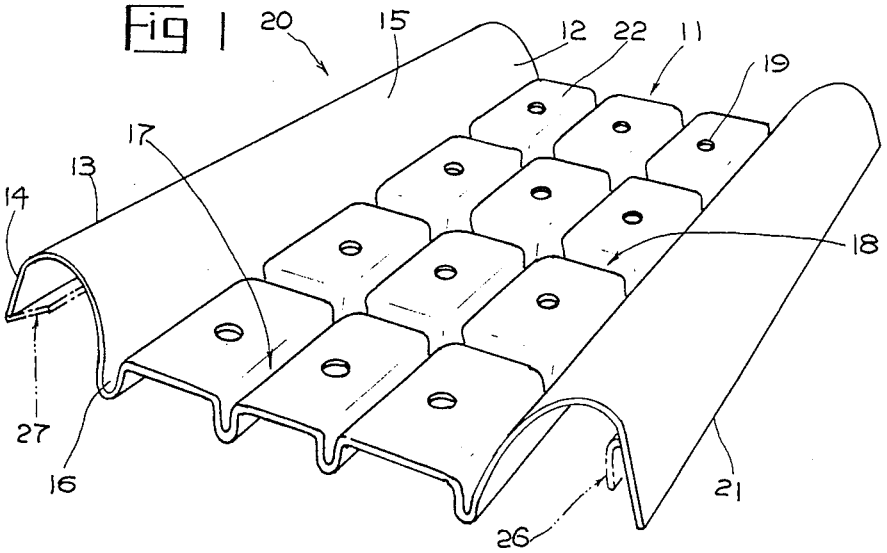
FIG. 1 is a perspective view of apparatus to upholster samples of seat top material.

The apparatus 20 of this invention to display a sample of seat top material in an upholstered form, by which the above mentioned objectives can be achieved is constructed with the following portions as illustrated in FIG. 1 in a typical embodiment;

(1) a flat plane 11 of width and length respectively from 20 to 100 cm, (2) upwardly inclined inner surfaces 12 and 12' extending from both sides of flat plane 11 reflectively from about 3 to 20 cm narrower than flat plane 11, (3) downwardly inclined other surfaces 14 and 14' wider than 3 cm, continuing from the top portions of upwardly inclined inner planes 12 and 12', (4) ridges 15 and 15', between which the flat plane 11 contains a wide bottom, formed with upwardly inclined inner surfaces 12 and 12' and downwardly inclined outer surfaces 14 and 14' on both sides of flat plane 11, (5) side channels 16 and 16' preferably of a width from about 3 to 10 mm and depth more than twice the width, formed along the border lines of flat plane 11 from where the upwardly inclined inner surfaces 12 and 12' upwardly incline, extending lengthwise and 18 extending across the width, (6) sub-channels 17 preferably of a width from about 3 to 10 mm and depth greater than the width. There is a recess or hole 19 suitably formed on each flat block 22 of the plane 11 as formed between the respective crossing sub-channels 17, 18 flat as desired.

The flat plane 11 with side channels 16 and 16' on both sides is not always necessary to be exactly flat. The flat plane 11 can be formed to be either convex or concave from one side channel 16 across the middle to the opposite side channel 16'.

If the flat plane 11 is formed to be convex, its middle portion preferably is to be from about 2 to 5 cm lower than the side channel 16 and 16' and the sub-channels 17 and 18 or the recesses or holes 19 are to be formed with a size of about 5–10 cm.

The flat plane 11, the inner surfaces 12 and 12' and the outer surfaces 14 and 14' can be cast or molded into one body of thin and somewhat elastic metal, wood or plastic plate, or assembled by fixing parts.

As mentioned above, according to this invention, since the flat plane 11 is similar to the concave middle portions of the seat and backrest of a chair and the upwardly inclined inner surfaces 12 and 12' and the downwardly inclined outer surfaces 14 and 14' are similar to curved border portions of seat and backrest of chair, when the whole surface of apparatus 20 is observed from one viewpoint, the angles from the viewpoint against each portion of the surface of apparatus 20 are varied running the gamut from flat to curved and at different angles. The appearance of the seat top material 23 applied on the apparatus 20 is highly varied and is observed as if it was actually applied on the chair. On the other hand, since the sample of seat top material 23 is detachably attached by embedding it into the channels 16, 17 and 18, it is very easy to change the sample applied to the apparatus 20 one after another, so from many samples the best choice can be decided speedily. Two tone color combination can easily be examined and decided upon.

As a result of this, fitting and cutting of seat top material 23 which was the usual method can be eliminated. Thus, the loss of material is eliminated. Moreover, the apparatus 20 is small, light and easy to be carried about when used for display of seat top material 23. For the clients to examine samples of seat top material 23 and seeing a finished product before purchasing, it is very convenient. On the other hand, since the apparatus 20 is used only to observe the appearance of the seat top material 23 and as it cannot be used by actually sitting or reclining on as a chair, even if the seat top material 23 is slightly attached on it, no trouble occurs from its attached condition.

As mentioned above, the apparatus is very useful and convenient as no sewing is needed. A realistic appearance can be observed, making it possible to make the best choice from many samples of seat top material 23. Therefore, this invention is very practical, economical and convenient.

FIG. 1 is a perspective view of a typical apparatus 20 to upholster samples of seat top material. The length of the apparatus is 285 mm molded in one piece of plastic plate of thickness 3 mm.

Numeral 11 designates a flat plane, 12 designates an upwardly inclined inner surface and 14 a downwardly inclined outer surface.

Numeral 16 designates a side channel of between the outermost flat planes and the upwardly inclined width 5 mm and depth 15 mm which is generally inner planes 12, 12' which is generally U-shaped in cross section.

The surface of each of upwardly inclined inner surface 12, 12' is convex and its cross section is acurate.

The width between top portion 13 and side channel 16 in the typical apparatus is 100 mm.

The top portion 13 is bent as an arch from the upwardly inclined inner surface 12 to the downwardly inclined outer surface 14.

The downwardly inclined outer surface 14 is flat and its edge is slightly angled in the width direction.

The width between top potion 13 and edge line 21 of the outer plane 11 is typically 60 mm.

The edge line 21 terminates at the same level as flat plane 11.

The flat plane 11 has a typical width of 285 mm divided in width into three equal parts by sub-channels 17 which extend in a straight line. The side channels 17 typically have a width of 5 mm and depth 15 mm.

Similarly, the length of the flat plane 11 is divided into four equal parts by the sub-channels 18 which typically have a width of 5 mm and depth of 15 mm.

Consequently, the flat plane 11 is divided into twelve equal blocks or panels 22 by the sub-channels 17 and 18.

The surfaces of these blocks are flat and formed at the same level and each surface has a hole of a typical diameter 2 mm.

Figure 2:
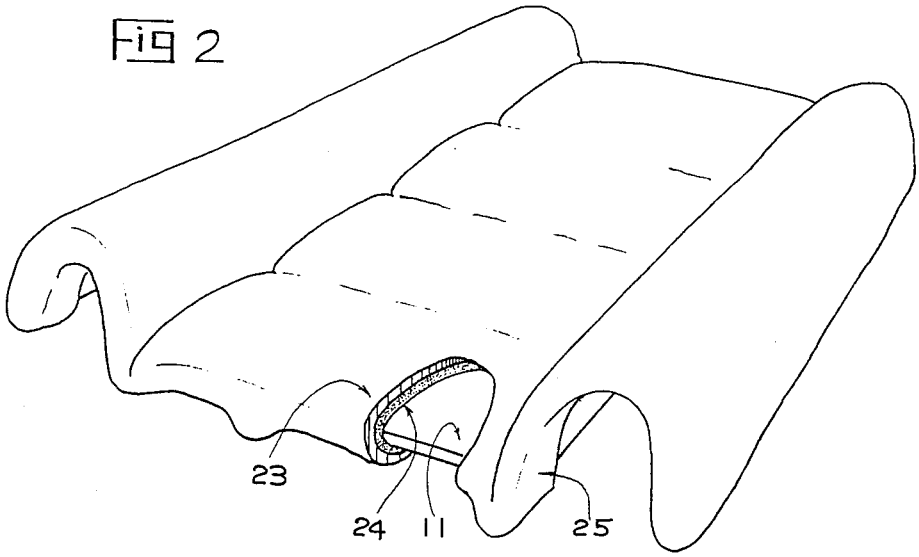
FIG. 2 is a perspective view of the apparatus of FIG. 1 upholstered to display samples of seat top material.

FIG. 2 is a perspective view of the apparatus 20 to upholster a sample of seat top material in use.

The seat top material 23 is upholstered on the apparatus in the following manner. First, sponge pad material 24 is laid on the apparatus 20. Next, the seat top material 23 is laid over the sponge pad material 24. Then with a spatula or similar object with a flat edge the seat top material 23 together 23 together with the sponge pad material 24 is pushed into the sub-channels 18. This is repeated for the side channels 16 and 16'. Finally, the overlapping edges 25 of these materials 23 and are taped into the inside of the apparatus.

Figure 3:
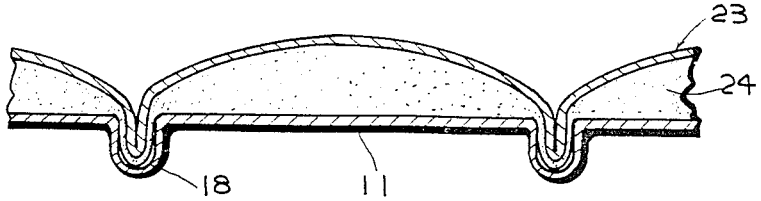
FIG. 3 is a sectional side view taken substantially at the sub-channel.

FIG. 3 is a cross section of a sub-channel 17 onto which the seat top material 23 and the sponge pad material 24 have been fixed. By forming a channel 26 on the inside of the outer surface 14 or backwardly collapsing a flange 27, it is possible to embed the overlapping edges 25 into the channel 26 or to fasten them with clips on the flange 27.

Figure 4:
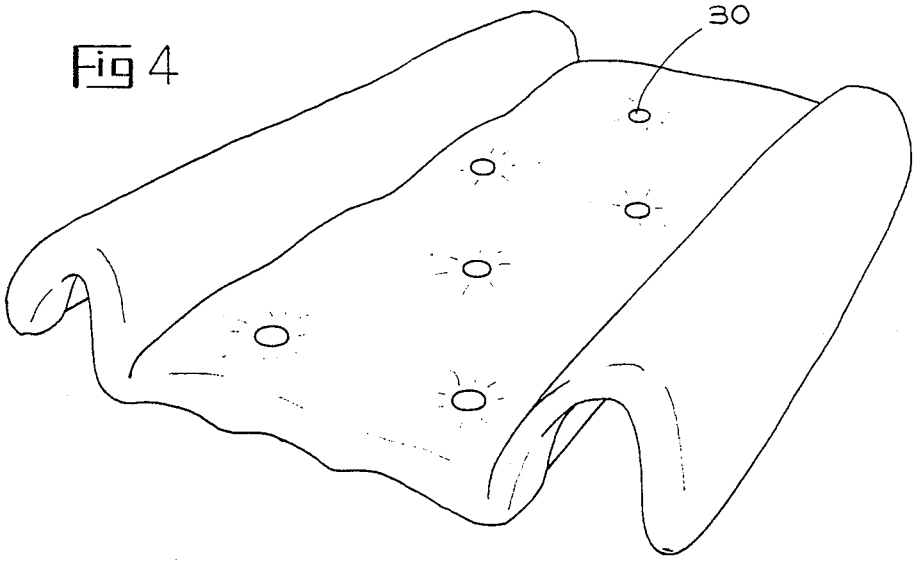
FIG. 4 is a perspective view of another embodiment of apparatus to display upholstered samples of seat top material.
Figure 5:
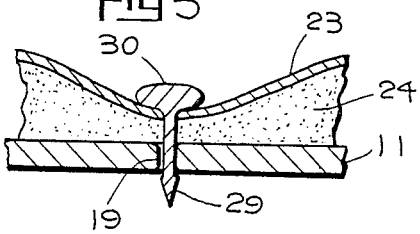
FIG. 5 is a sectional side view taken substantially of the flat plane.

FIGS. 4 and 5 illustrate another embodiment of the apparatus 20 to upholster sample of seat top material provided by this invention. In this case, the seat top material 23 and the sponge pad material 24 are fixed to the flat plane 11 by using buttons 30 having a pin 29 to be fixed into the hole 19.

Figure 6:
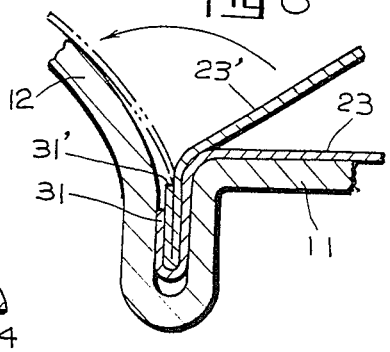
FIG. 6 is a sectional side view taken substantially of the side channel.

FIG. 6 illustrates another use of the apparatus 20. In this case, two different seat top materials 23 and 23' with edges 31 and 31' together and the fabric pattern sides facing each other are embedded into the side channel 16, and the wrong side of one piece of material 23' is turned to be fixed on the upwardly inclined inner surface 12.

Figure 7:
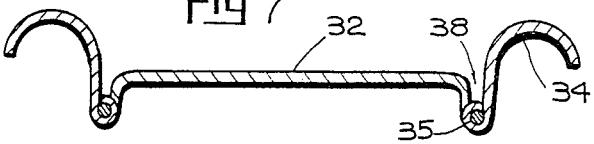
FIG. 7, FIG. 8 and FIG. 9 are respectively sectional side views of other embodiments of assembled apparatus to upholster sample of seat top material.

The above mentioned apparatus 20 is made of plastic in one body, but the same can be assembled in parts as follows. That is, in the embodiment illustrated in FIG. 7, flat plate part 32 and arched parts 34 are connected with hinges 35 and channels 38 are formed between them.

Figure 8:
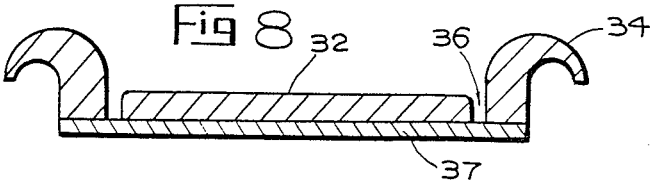

In the embodiment illustrated in FIG. 8, flat plate part 32 and arched parts 34 are respectively detachably attached to base plate 37 to form channels 36 between them.

Figure 9:
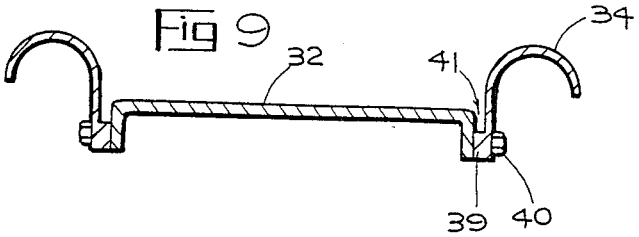

In the embodiment illustrated in FIG. 9, screw bolts 40 fix the inner end of arched parts 34 from which a rib 39 projects to the flat plate parts 32 to form channels 41 between them and above ribs 39.

The sample of seat top material 23 is detachably attached by embedding it with a spatula or the like into the channels 16, 17, 18, 36, 38 and 41. Thus, material applied on the apparatus 20 can be very easily changed one after another and thus from many samples the best choice can be decided speedily.

As mentioned above, the apparatus is very useful, therefore, this invention is very practical, economical and convenient.

I claim:

1. Apparatus to display a sample of sheet material comprising a central section having opposed sides;

an upwardly inclined inner surface extending from at least one side of said central section, a downwardly inclined surface continuing outwardly from said inner surface, a depressed first channel along the length of the intersection of said central section and said upwardly inclined inner surface, and at least one depressed second channel extending across said central section to divide said central section into a plurality of panels, the material to be displayed laid over said central section and inner and outer surfaces, and inserted into said first and second channels to be held therein.

2. Apparatus as in claim 1 where there is a curved arch between said inner and outer surfaces.

3. Apparatus as in claim 2 further comprising an upwardly inclined inner surface and downwardly inclined outer surface with a curved arch therebetween on each side of said central section.

4. Apparatus as in claim 3 wherein there are a plurality of said second channels.

5. Apparatus as in claim 4 wherein said central section is flat.

6. Apparatus as in claim 4 wherein said central section is convex.

7. Apparatus as in claim 1 further comprising at least one depressed third channel in said central section which is generally parallel to said first channel and generally transverse to said second channel.

8. Apparatus as in claim 1 further comprising hinge means to attach said inner surface to said central section.

* * * * *